United States Patent [19]

Igarashi et al.

[11] Patent Number: 4,799,033

[45] Date of Patent: Jan. 17, 1989

[54] MICROWAVE SEPARATOR

[75] Inventors: Sadao Igarashi; Moriaki Ueno, both of Soma, Japan

[73] Assignee: Alps Electric Co., Ltd., Japan

[21] Appl. No.: 27,788

[22] Filed: Mar. 19, 1987

[30] Foreign Application Priority Data

Aug. 7, 1986 [JP] Japan ..... 61-185868

[51] Int. Cl.[4] ..... H01P 5/12

[52] U.S. Cl. ..... 333/134; 333/202; 333/206

[58] Field of Search ..... 333/126, 129, 134, 202, 333/203, 206

[56] References Cited

U.S. PATENT DOCUMENTS

| | | | |
|---|---|---|---|
| 3,617,954 | 11/1971 | Levy et al. | 333/203 |
| 4,121,181 | 10/1978 | Nishikawa et al. | 333/202 |
| 4,246,555 | 1/1981 | Williams | 333/209 |
| 4,427,953 | 1/1984 | Hudspeth et al. | 333/134 |
| 4,431,977 | 2/1984 | Sokola et al. | 333/206 |
| 4,660,004 | 4/1987 | Jachowski | 333/203 X |

FOREIGN PATENT DOCUMENTS

| | | | |
|---|---|---|---|
| 112702 | 6/1984 | Japan | 333/134 |

*Primary Examiner*—Paul Gensler

*Attorney, Agent, or Firm*—Guy W. Shoup; Paul J. Winters

[57] ABSTRACT

A microwave separator for separating a microwave signal to those having frequencies included in two frequency bands by means of a first band pass filter intended for the low frequency band and a second filter intended for the high frequency band, characterized in that said first band pass filter is of the comb line type and that said second band pass filter is of the coaxial type in which plural coaxial type resonators are connected one another in series through capacitors. As the result, microwave signals can be reliably separated at two adjacent frequency bands without any signal loss and the return losses of the band pass filters can be improved accordingly.

1 Claim, 5 Drawing Sheets

MICROWAVE SEPARATOR

BACKGROUND OF THE INVENTION (a) Field of the Invention

The present invention relates to a microwave separator for separating a microwave signal to those having frequencies included in two frequency bands.

(b) Prior Art

The car telephone employs the two-way communication system which enables transmission and reception to be achieved using the microwave signal at a band of 800 MHz. In the case of this car telephone, communication is carried out using a transmission signal included in a transmission frequency band of 825–851 MHz and a reception signal included in a reception frequency band of 870–896 MHz. A microwave separator for separating these transmission and reception signals is arranged at an input/output section of the car telephone.

FIG. 4 is a block diagram roughly showing the microwave separator. A transmission signal input terminal 76 is connected to one end of a first band-pass filter 73 (which will be hereinafter referred to as BPF) and which takes the transmission frequency band as its pass band, while an end of a coaxial cable 78 having a wavelength which is a quarter of that of the center frequency in the transmission frequency band is connected to the other end of the BPF. A reception signal output terminal 77 is connected to one end of a second BPF 74 which takes the reception frequency band as its pass band, while an end of a coaxial cable 79 having a wavelength which is a quarter of that of the center frequency in the reception frequency band is connected to the other end of the second BPF 74. The other ends of the coaxial cables 78 and 79 are connected to an antenna terminal 75. The coaxial cables 78 and 79 are used to reduce those undesirable influences which the first and second BPFs 73 and 74 exert on each other.

The BPFs 73 and 74 are needed to have a sharp skirting characteristic because their pass bands are wide and because the transmission and reception frequency bands are close to each other. The car telephone and other such equipment need to be small-sized and light-weighted.

Therefore, filters of the coaxial or comb line type are conventionally used as the first and second BPFs for the microwave separator.

The filter of the coaxial type will be briefly described referring to FIGS. 5 and 6, of which FIG. 5 is a perspective view showing the filter of the coaxial type and FIG. 6 is a circuit diagram showing the filter.

In FIG. 5, the coaxial type filter comprises providing inner conductors 86–90 on inner walls of resonators 80–84 of the coaxial type, respectively, which are cylindrical dielectrics, locating the resonators 80–84 between terminals 97 and 98, and connecting the inner conductors 86–90 in series to the terminals 97 and 98 through capacitors 91–96.

The circuit of this coaxial type filter has an arrangement of the capacity coupling in which the coaxial type resonators 80–84 are connected in series to one another through the capacitors 92–95, as shown in FIG. 6. The skirting characteristic is sharp at low band, but attenuation is small and the skirting characteristic is gentle at high band in this case. Numerals 99–103 represent fringing capacities and numerals 104–108 equivalent coaxial lines.

The filter of the comb line type will be described referring to FIGS. 7 and 8, of which FIG. 7 is a perspective view showing the filter of the comb line type and FIG. 8 a circuit diagram showing the filter in FIG. 7.

In FIG. 7, the comb line type filter comprises providing holes in a rectangular-parallelepiped-shaped dielectric 114 along a center line thereof with an equal interval interposed between them, forming inner conductors 109–113 of plating on inner walls of the holes, providing conductors on those faces of the dielectric 114 except the top face thereof at which the holes are opened, and connecting the inner conductors 109 and 113 located on both sides to terminals 117 and 118 through capacitors 115 and 116.

The circuit of this comb line type filter comprises inductively coupling resonators by equivalent coaxial lines 119–122, and the skirting characteristic is sharp at high band but attenuation is small and the skirting characteristic is gentle at low band in this case. Numerals 123–127 represent fringing capacities and numerals 128–132 equivalent coaxial lines.

In the case of the conventional microwave separator, either of the coaxial type filters or comb line type filters are used as the first and second BPFs 73 and 74.

FIG. 9 shows the characteristic of the microwave separator in which the coaxial type filters are used as the first and second BPFs 73 and 74. As apparent from FIG. 9, the skirting characteristic is not sharp enough at high band relating to a property A of the first BPF 73 in the case of this microwave separator provided with the coaxial type filters and it overlaps the skirting characteristic which is related, at low band, to a property B of the second BPF 74. Return loss of the second BPF 74 is thus worsened, as shown by D in FIG. 9, thereby causing the receiving sensitivity to be made worse.

FIG. 10 shows the characteristic of the microwave separator in which the comb line type filters are used as the first and second BPFs 73 and 74. As apparent from FIG. 10, the skirting characteristic is not sharp enough at low band relating to a property F of the second BPF 74 in the case of this microwave separator provided with the comb line type filters and it overlaps the skirting characteristic which is related, at high band, to a property E of the first BPF 73. Signals at the transmission frequency band are therefore likely to leak into the reception frequency band, so that normal operation cannot be carried out on the reception side to thereby lower the receiving sensitivity. Further, the return loss of the first BPF 73 become worse, as shown by G in FIG. 10, radio wave emitted from the antenna is weakened, and heat value is increased at the final stage on the reception side.

C, D in FIG. 9 and G, H in FIG. 10 represent the return losses of the first and second BPFs 73 and 74 obtained when they are of the coaxial type and of the comb line type, respectively.

The number of stages of the resonators can be increased to make the skirting characteristic sharp, but when so arranged, signal loss is increased accordingly in the pass band, thereby making it difficult to adjust the resonators. This measure is not therefore practical.

SUMMARY OF THE INVENTION

The present invention is intended to eliminate the above-mentioned drawbacks of the conventional microwave separators.

The object of the present invention is therefore to provide a microwave separator capable of making the skirting characteristic of the first BPF for a low frequency band sharp at high band and that of the second BPF for a high frequency band also sharp at low band to reliably separate microwave signals.

This object of the present invention can be achieved by a microwave separator for separating a microwave signal to those having frequencies included in two frequency bands by means of a first BPF for a low frequency band and a second BPF for a high frequency band, characterized in that said first BPF is of the comb line type and that said second BPF is of the coaxial type in which a plurality of coaxial type resonators are connected in series to one another through capacitors.

According to the present invention, the comb line type filter which enables the skirting characteristic to be made sharp at high band is used as the first BPF for the low frequency band, while the coaxial type filter which enables the skirting characteristic to be made sharp at low band is used as the second BPF for the high frequency band. The microwave signal can be thus reliably separated at those portions of the two frequency bands which are adjacent to each other, thereby causing no signal loss at these portions and improving the return loss.

DETAILED DESCRIPTION OF THE PREFERRED EMBODIMENT

Figure 1:
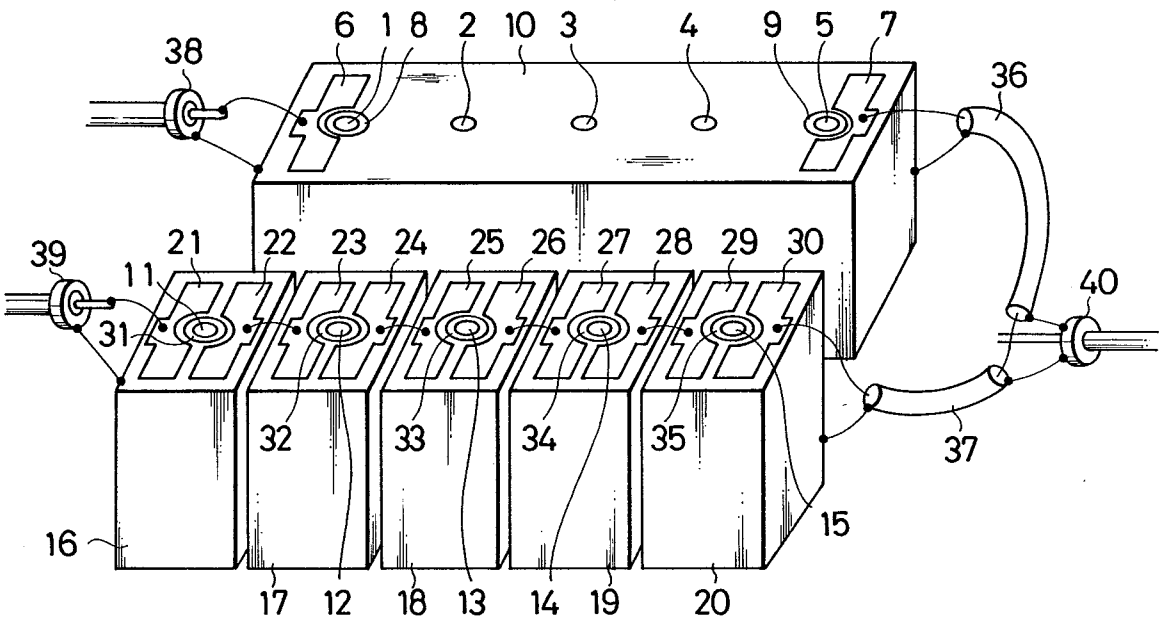
FIG. 1 is a perspective view showing an example of the microwave separator according to the present invention.
Figure 2:
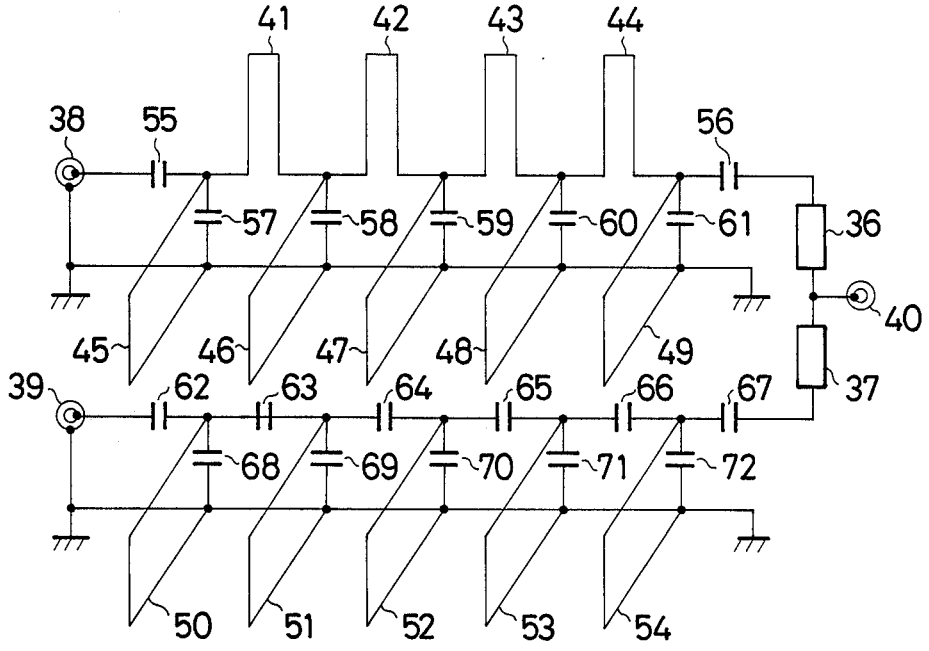
FIG. 2 is a circuit diagram showing the microwave separator in FIG. 1.
Figure 3:
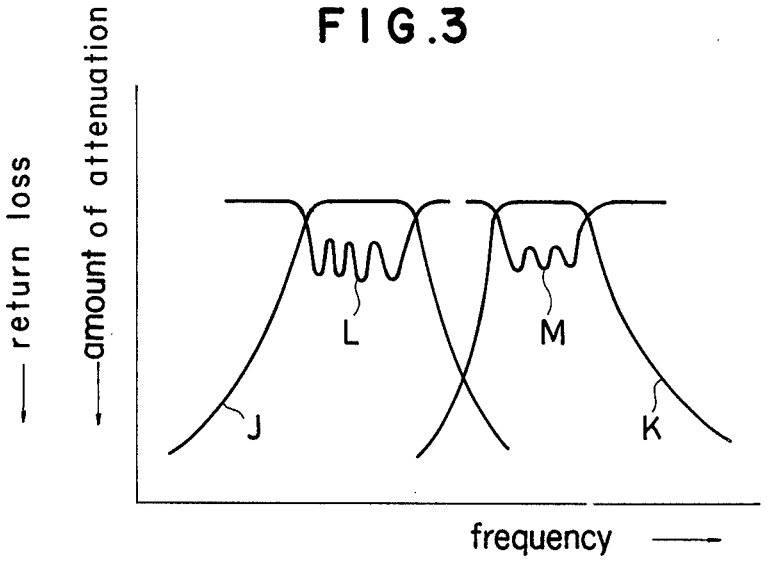
FIG. 3 shows the characteristic of the microwave separator in FIG. 1.
Figure 4:
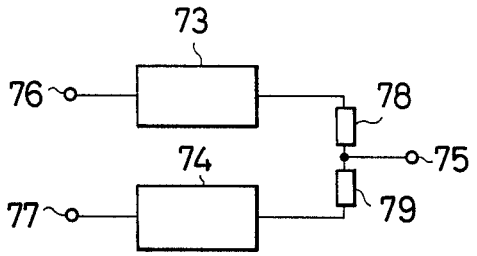
FIG. 4 is a block diagram roughly showing the microwave separator.

An embodiment of the present invention will be described referring to FIGS. 1 through 3, of which FIG. 1 is a perspective view showing an example of the microwave separator according to the present invention, FIG. 2 is a circuit diagram showing the microwave separator, and FIG. 3 shows the characteristic of the microwave separator.

In FIG. 1, holes are provided in a rectangular-parallelepiped-shaped dielectric 10 along a center line thereof with an equal interval interposed between them and inner conductors 1-5 of plating are formed on the inner walls of these holes. Conductors are further provided on the faces of the dielectric 10 except the top face thereof at which the holes are opened. Electrodes 8 and 9 respectively continuous from the inner conductors 1 and 5 located on both sides are provided on the top face of the dielectric 10 and electrodes 6 and 7, adjacent to the electrodes 8 and 9 respectively, are further provided on the top face of the dielectric 10. The electrode 6 is connected to a connector which serves as a transmission signal input terminal 38, while the other electrode 7 is connected to one end of a coaxial cable 36 whose wavelength is a quarter of that of a center frequency in a transmission signal frequency band.

A hole is also formed in each of plural dielectric blocks 16-20 which are smaller in rectangular parallelepiped than the dielectric 10, and inner conductors 11-15 of plating are provided on the inner walls of these holes. Conductors are further provided on the faces of each of the dielectric blocks 16-20 except the top face thereof at which the hole is opened. Further, electrodes 31-35 continuous from their corresponding inner conductors 11-15 are provided on the top faces of the dielectric blocks 16-20 and pairs of two electrodes 21-30 adjacent to their corresponding electrodes 31-35 are also provided on the top faces of the dielectric blocks 16-20. These plural dielectric blocks 16-20 are arranged on a line and the electrode 21 of the dielectric block 16 located on one side is connected to a connector which serves as a reception signal output terminal 39. Connections are further made between the electrodes 22 and 23, between the electrodes 24 and 25, between the electrodes 26 and 27, and between the electrodes 28 and 29. The electrode 30 of the dielectric block 20 located on the other side is connected to one end of a coaxial cable 37 whose wavelength is a quarter of that of a center frequency in a reception frequency band.

The other ends of the coaxial cables 36 and 37 are connected to a connector which serves as an antenna terminal 40.

Figure 5:
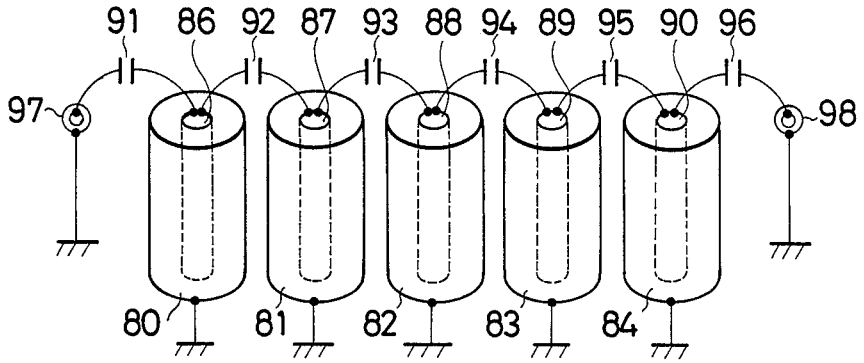
FIG. 5 is a perspective view showing a filter of the coaxial type.
Figure 6:
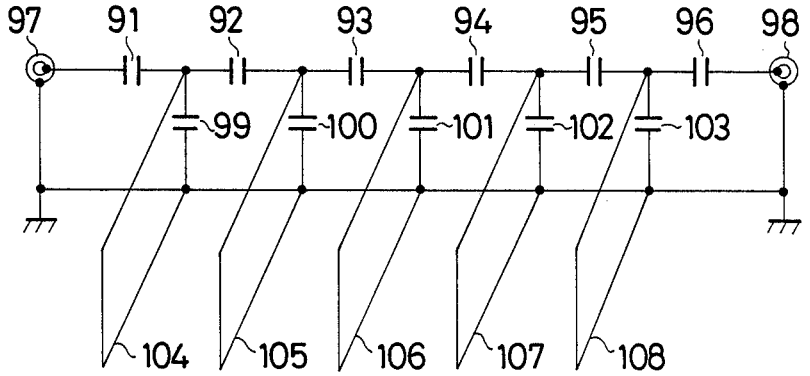
FIG. 6 is a circuit diagram showing the coaxial type filter in FIG. 5.
Figure 7:
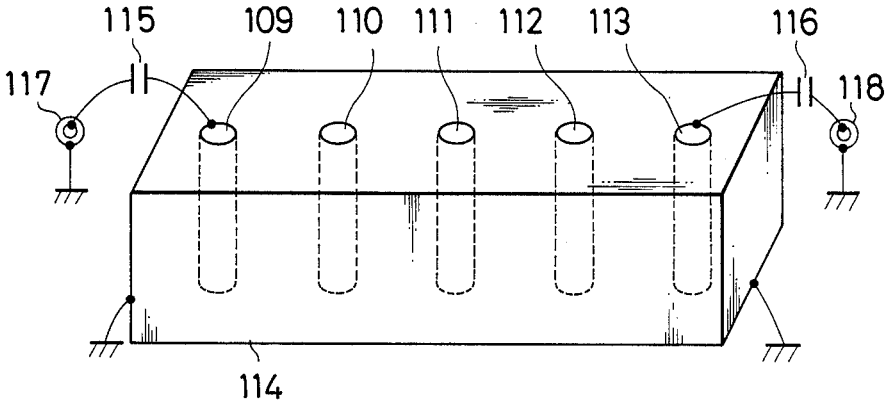
FIG. 7 is a perspective view showing a filter of the comb line type.
Figure 8:
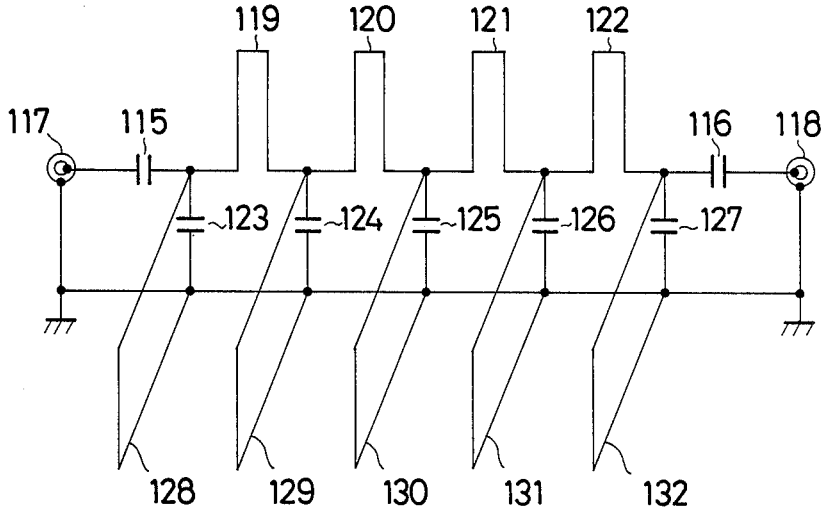
FIG. 8 is a circuit diagram showing the comb line type filter in FIG. 7.
Figure 9:
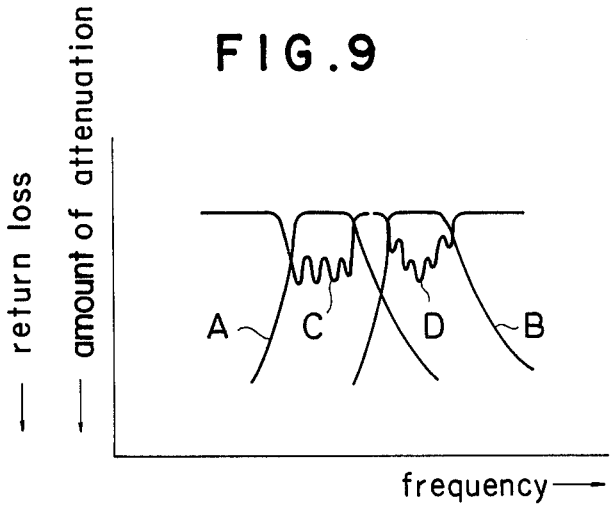
FIG. 9 shows the characteristic of a microwave separator in which the coaxial type filters are used as first and second BPFs.
Figure 10:
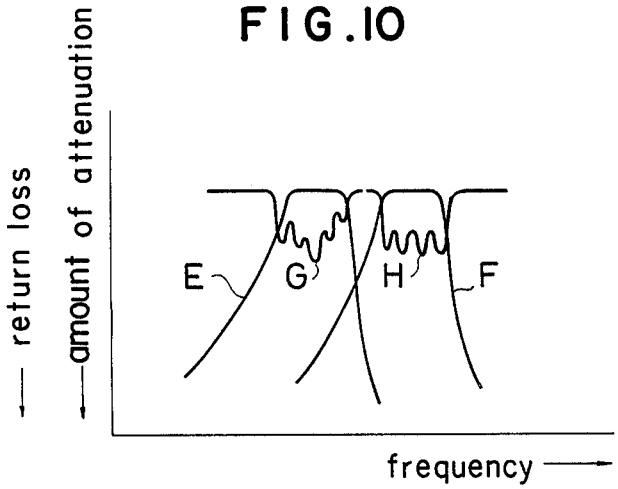
FIG. 10 shows the characteristic of a microwave separator in which the comb line type filters are used as the first and second BPFs.

When arranged as described above, a capacitor of the comb line type similar to the one shown in FIG. 7 is formed by the electrodes 6, 8 and 9, 7 provided on the dielectric 10 and it is used as a first BPF for a low transmission frequency band. The inner conductors 11-15 are connected one another in series by the electrodes 21-35 on the dielectric blocks 16-20 through capacitors. A filter of the coaxial type similar to the one shown in FIG. 5 is thus formed and used as a second BPF for a high reception frequency band. As shown by the circuit diagram in FIG. 2, therefore, the induction-coupled comb line type filter is interposed between a transmission signal input terminal 38 and an antenna terminal 40, while the capacity-coupled coaxial type filter is interposed between a reception signal output terminal 39 and the antenna terminal 40. In FIG. 2, numerals 41-54 represent equivalent coaxial lines, numerals 55-56 and 62-67 capacitors formed by the electrodes 6 and 8, 9 and 7, and 21-35, and numerals 57-61 and 68-72 fringing capacities.

In the case of the microwave separator arranged as described above, both of the skirting characteristics can be made sharp at high and low bands relating to both properties J and K of the first and second BPFs 73 and 74 intended for the low and high frequency bands, thereby enabling signals transmitted to be reliably separated from those received and causing no signal leakage between them. In addition, return losses L and M of the first and second BPFs 73 and 74 can be improved accordingly.

Although the microwave separator of the present invention has been described referring to a case where it is used in the input/output section of the car telephone, it should be understood that the microwave separator is not limited to the above case but that it may be applied to other communication systems so as to separate the microwave signal at two adjacent frequency bands.

According to the microwave separator of the present invention as described above, the skirting characteristics of the BPFs can be made sharp at those portions of the low and high frequency bands which are adjacent to each other, thereby enabling the microwave signals to be reliably separated without any their leakage and improving the return losses of the BPFs accordingly. In addition, the high and low frequency bands can be reliably separated from each other, thereby enabling the number of stages for the resonators to be decreased so that loss in the pass band can be reduced accordingly and that adjustment can be made easier.

We claim:

1. In a microwave separator of the type having a first band pass filter connected between a signal input terminal and one end of a first coaxial cable for filtering a lower frequency band of an input microwave signal, a second band pass filter connected between a signal output terminal and one end of a second coaxial cable for filtering a higher frequency band of the input microwave signal, wherein the other ends of the first and second coaxial cables are connected in parallel to a common signal input/output source, the improvement comprising said first band pass filter being of the comb type having a plurality of inner conductors formed in a line through a dielectric block; and said second band pass filter being of the coaxial type in which a plurality of coaxial type resonators are connected to one another in series through respective capacitances.

* * * * *